US006353964B1

(12) United States Patent
Andrisin, Jr. et al.

(10) Patent No.: US 6,353,964 B1
(45) Date of Patent: Mar. 12, 2002

(54) CLEANING ATTACHMENT FOR VACUUM CLEANER

(75) Inventors: John J. Andrisin, Jr., Parma, OH (US); Wei Du, Dubuque, IA (US)

(73) Assignee: The Scott Fetzer Company, Westlake, OH (US)

( * ) Notice: Subject to any disclaimer, the term of this patent is extended or adjusted under 35 U.S.C. 154(b) by 0 days.

(21) Appl. No.: 09/490,091

(22) Filed: Jan. 24, 2000

(51) Int. Cl.[7] ..... A47L 9/04

(52) U.S. Cl. ..... 15/387; 15/322; 15/246.2; 15/380

(58) Field of Search ..... 15/246.2, 246.3, 15/246.4, 321, 322, 377, 380, 382, 387, 21.1, 22.2, 33, 37, 50.2, 52.2, 28; 451/356, 357

(56) References Cited

U.S. PATENT DOCUMENTS 983,988 A 2/1911 Foster et al.
2,338,339 A * 1/1944 La Mere et al.
2,514,142 A 7/1950 Reid
3,046,586 A 7/1962 Allen et al.
3,206,787 A 9/1965 Daniels et al.
RE29,247 E * 6/1977 Kilstrom et al.
4,167,798 A 9/1979 Klugl et al.
4,355,487 A * 10/1982 Maier et al.
4,393,808 A * 7/1983 Roden et al.
4,972,544 A * 11/1990 Reid
5,088,149 A 2/1992 Berg et al.
5,168,599 A 12/1992 Williams
5,184,370 A 2/1993 Jung
5,416,948 A 5/1995 Worwag
5,493,752 A 2/1996 Crouser et al.
5,974,615 A * 11/1999 Schwarz-Hartmann et al.
5,993,305 A * 11/1999 Chu
6,148,475 A * 11/2000 Stross

* cited by examiner

*Primary Examiner*—Terrence R. Till
(74) *Attorney, Agent, or Firm*—Jones, Day, Reavis & Pogue

(57) ABSTRACT

A floor cleaning apparatus includes a cleaning element and a vibratory agitation device. The cleaning element is configured to adjoin a floor in scrubbing engagement with the floor. The vibratory agitation device has an output member, and is operative to impart oscillation to the output member. The output member is connected with the cleaning element to impart oscillation to the cleaning element upon operation of the vibratory agitation device when the cleaning element is in scrubbing engagement with the floor.

6 Claims, 4 Drawing Sheets

CLEANING ATTACHMENT FOR VACUUM CLEANER

BACKGROUND OF THE INVENTION

The present invention relates to the field of floor scrubber devices.

Several methods are known for cleaning a hard floor. In the typical manual method, a cleaning head is attached to the end of a long handle, which is dipped in a pail of cleaning solution, wrung out and applied to floor by the operator, who manually scrubs the floor using a reciprocating scrubbing action. The cleaning head is again dipped into the pail and wrung out to remove the dirty cleaning solution. In the manual method, considerable operator effort is required to scrub with the cleaning head and wring out the dirty solution. Also, it is difficult to remove all the dirty solution from the floor, and the remaining dirt on the floor is a source of bacteria, odor and dull appearance.

Automated cleaning devices are known for scrubbing floors. One common device includes a long handle supporting a cleaning head, which is attached by a suction air hose to a separate unit that sits on the floor, containing a suction air pump and a dirty solution collection tank. The unit can include a cleaning solution storage tank and a valve/hose structure for dispensing cleaning solution onto the floor. However, in some previous devices, cleaning solution is applied manually. The operator scrubs the floor manually with a reciprocating scrubbing action. The dirty solution is removed through a nozzle using suction air from the suction air pump and is passed through the connecting hose to the collection tank. Such automated devices still require considerable operator effort in applying reciprocating scrubbing action. Also, a separate suction air pump adds cost to the device. Some previous devices incorporate the above-listed elements into a single unit. However, such devices are heavy and difficult to move since the suction air pump is contained in the same unit that includes the cleaning head.

SUMMARY OF THE INVENTION

In accordance with the present invention, a floor cleaning apparatus comprises a cleaning element and a vibratory agitation device. The cleaning element is configured to adjoin a floor in scrubbing engagement with the floor; The vibratory agitation device has an output member, and is operative to impart oscillation to the output member. The output member is interconnected with the cleaning element to impart oscillation to the cleaning element upon operation of the vibratory agitation device when the cleaning element is in scrubbing engagement with the floor.

In a preferred embodiment of the invention, the output member and cleaning element are oriented relative to each other such that the oscillation imparted to the cleaning element includes reciprocation in opposite directions parallel to the floor, and further includes reciprocation movement in opposite directions perpendicular to the floor.

DESCRIPTION OF PREFERRED EMBODIMENTS

Figures 1, 2:
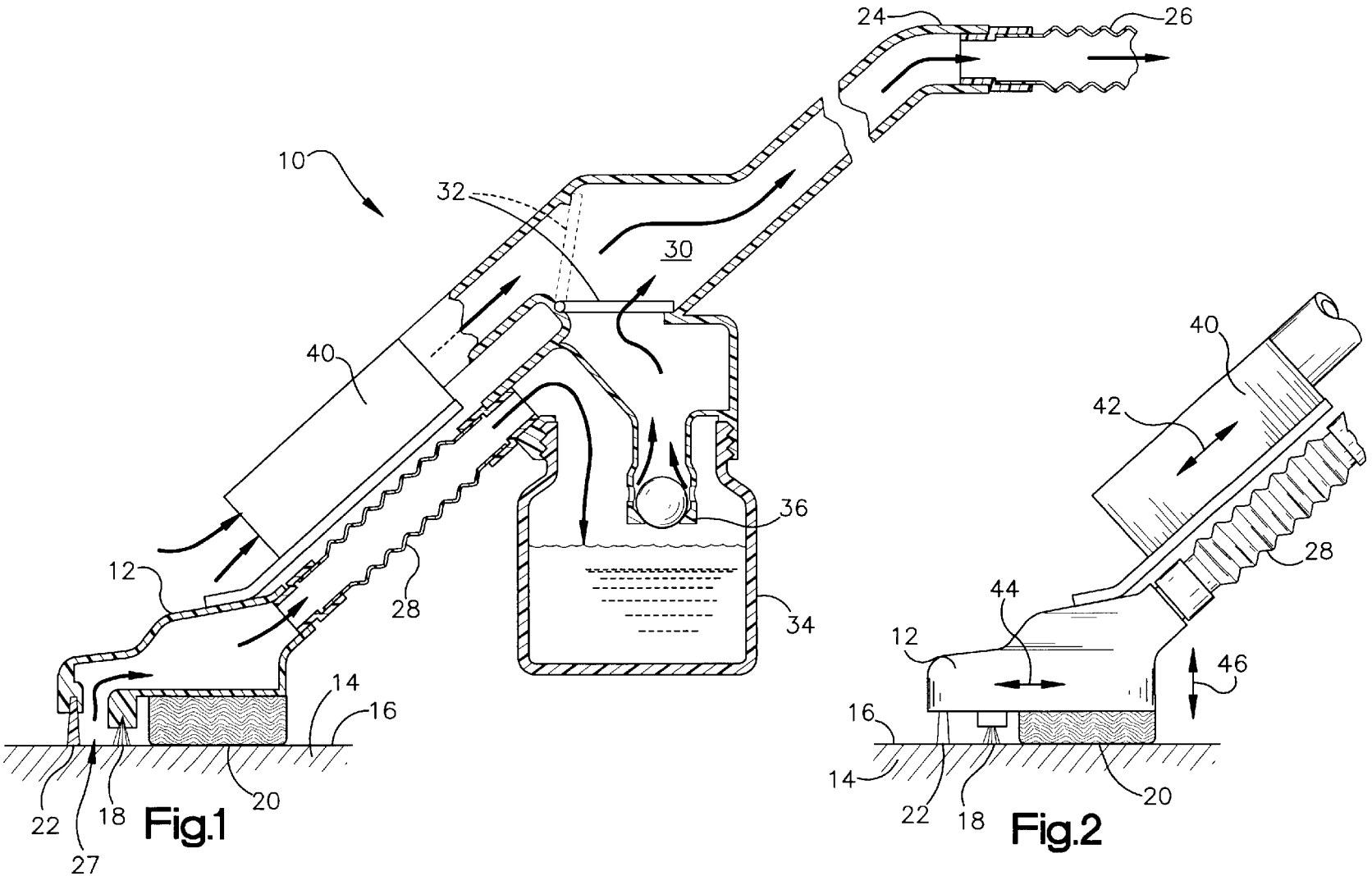
FIG. 1 is a is a schematic view of an apparatus comprising a first embodiment of the present invention.
FIG. 2 is a partial view of the apparatus of FIG. 1.

A floor cleaning apparatus 10 comprising a first embodiment of the present invention is shown partially in FIG. 1. The apparatus 10 includes a combined cleaning/solution-pick-up head 12 for scrubbing and removing dirty solution from a floor 14. Although FIG. 1 shows a floor 14 with a hard surface 16, the invention is equally applicable to soft floor surfaces defined by carpets or rugs. The combined head 12 has cleaning elements including a brush 18 and a sponge 20 for scrubbing. A squeegee 22 is included for displacing standing water for removal.

The apparatus 10 is an attachment to a vacuum cleaner and derives its power from the suction air of the vacuum cleaner. As shown in FIG. 1, a handle portion 24 of the apparatus 10 is connected to a suction hose 26 extending from the vacuum cleaner. The head 12 has a cleaning solution intake port 27, and is connected to a lower hose portion 28 of the apparatus 10. The lower hose 28 communicates pneumatically with the suction hose 26 through a plenum 30 in the handle 24.

During operation, dirt-laden cleaning solution can be removed from the floor 14. A suction air valve 32 in the plenum 30 can be opened, as shown in dashed lines in FIG. 1, to permit a flow of air from the cleaning head 12 to the suction hose 26 through the lower hose 28 and the plenum 30. Any suitable handle (not shown) can project from the valve 32 for an operator of the apparatus 10 to shift the valve 32. The dirt-laden cleaning solution is then drawn up with the air flow and deposited in a collection tank 34. A float valve 36 is provided to block the flow of air from the hose 28 to the plenum 30 if the collection tank 34 becomes too fill. When the suction air valve 32 is closed, air can flow upward into the plenum 30 through a vibratory agitation device 40.

Referring particularly now to FIG. 2, the vibratory agitation device 40 is used to agitate the cleaning head 12 for thorough removal of dirt from the floor 14. Specifically, the vibratory agitation device 40 in the preferred embodiment operates to oscillate the cleaning head 12 such that the cleaning elements 18 and 20 anchored to the cleaning head 12 reciprocate in opposite directions parallel to the floor surface 16, and further reciprocate in opposite directions perpendicular to the floor surface 16, when the cleaning head 12 is in scrubbing engagement with the floor 14. This is preferably accomplished by generating a vibratory reciprocating action that is directed at an angle to the floor 14 between zero and ninety degrees, as indicated in FIG. 2 by a reciprocating vibration force vector 42. The force vector 42 can be resolved into a horizontal force vector 44 and a vertical force vector 46. The horizontal force vector 44 passes the brush 18 and the sponge 20 across the floor surface 16 to apply a scrubbing force. The vertical force vector 46 applies a deep cleaning digging force to push the brush 18 and the sponge 20 into any recesses or crevices at the floor surface 16.

Figure 3:
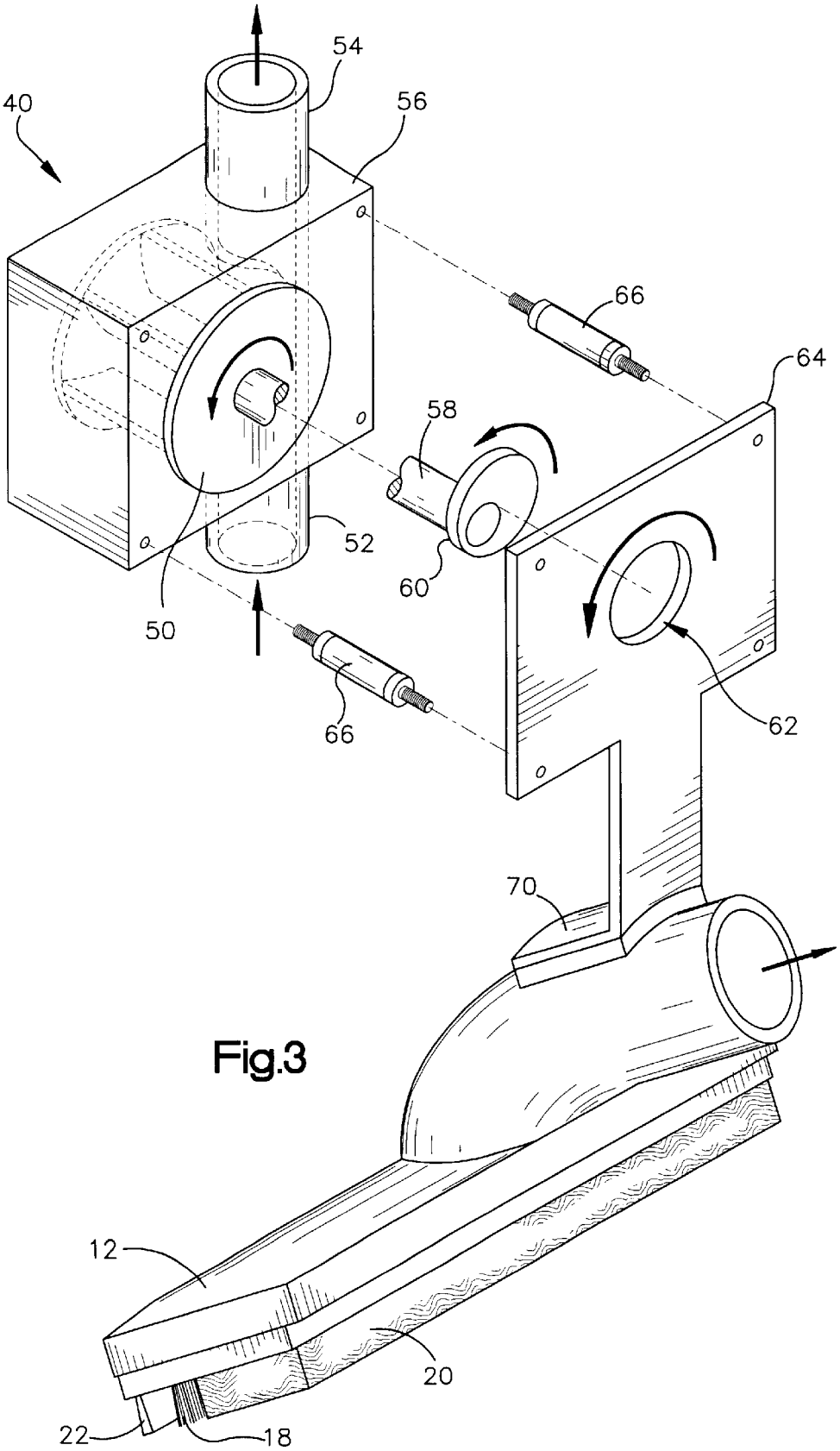
FIG. 3 is an exploded view of parts of the apparatus of FIG. 1.

As shown in FIG. 3, the vibratory agitation device 40 includes an air impeller wheel 50 which is rotated by the suction air flow entering through an inlet 52 and exiting through an outlet 54. The impeller 50 is mounted for rotation in a housing 56 and has a central shaft 58 with a circular cam 60. The cam 60 is received closely within a circular opening 62 in an output bracket 64 to establish an eccentric driving connection between the impeller 50 and the output bracket 64. Four flexible mounts 66, two of which are shown in FIG. 3, support the output bracket 64 on the housing 56 for oscillation relative to the housing 56 under the influence of the rotating cam 60.

A foot portion 70 of the output bracket 64 fixed to the cleaning head 12 so that the oscillating bracket 64 imparts corresponding oscillation to the cleaning head 12. Importantly, the output bracket 64 is configured and oriented relative to the cleaning head 12 in a manner that results in application of the reciprocating cleaning force vectors 44 and 46 to the floor 14 through the cleaning elements 18 and 20 when the cleaning head 12 is in scrubbing engagement with the floor 14, as shown in FIG. 2.

Figure 4:
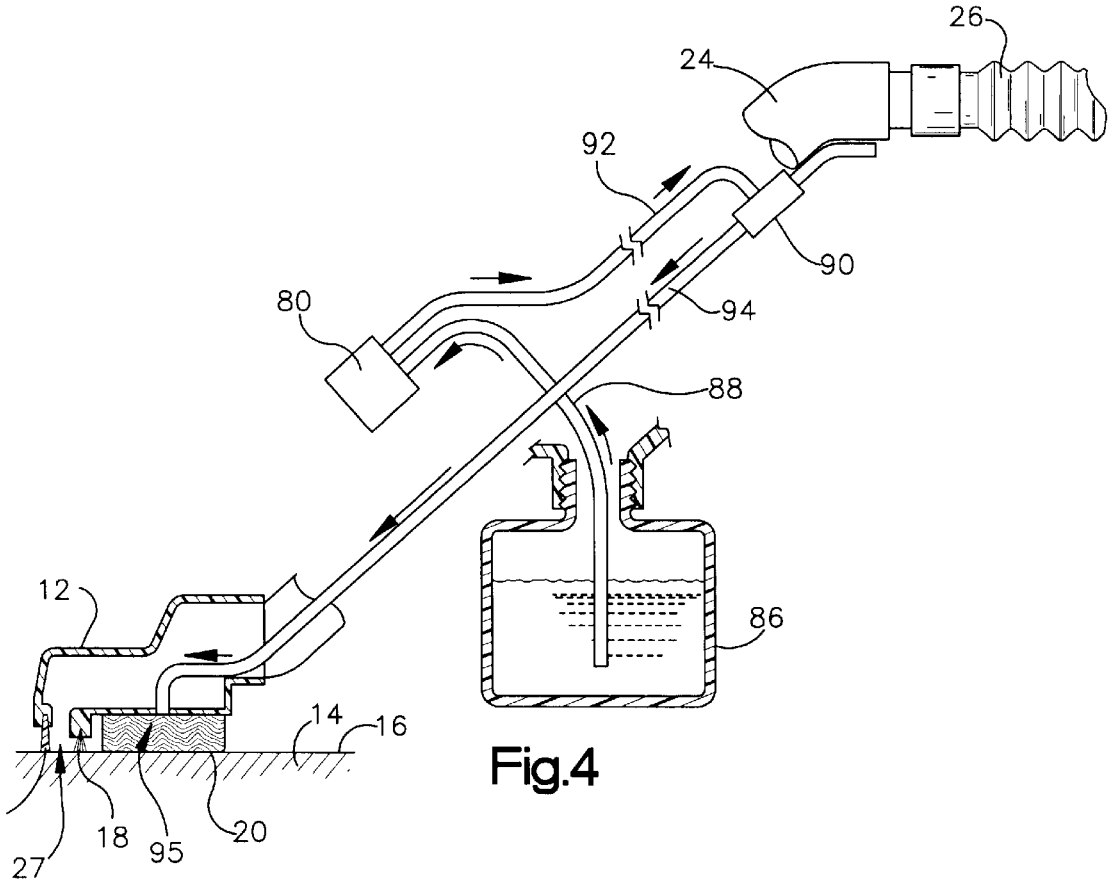
FIG. 4 is a schematic view similar to FIG. 1 showing different parts of the apparatus.
Figure 5:
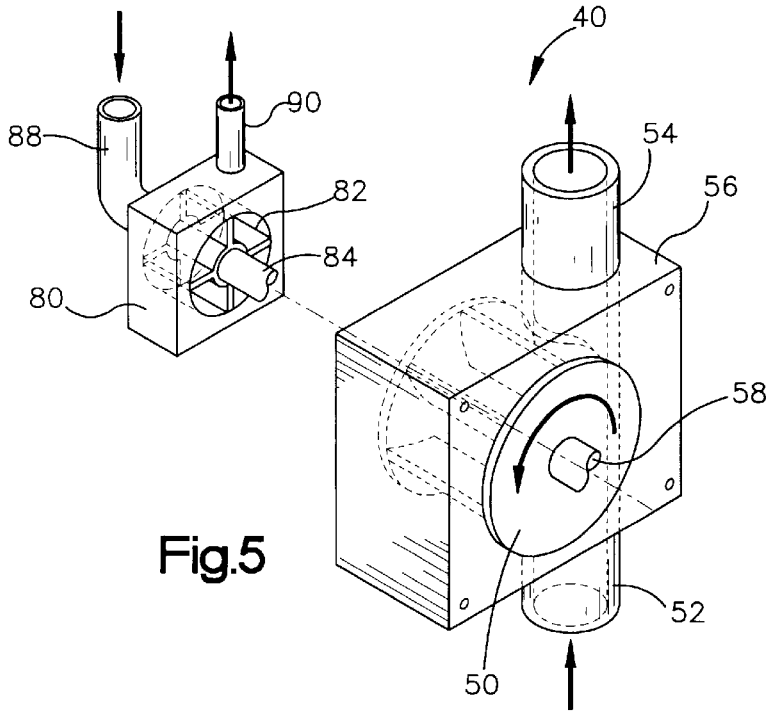
FIG. 5 is an exploded view of parts shown in FIGS. 3 and 4.

Additional parts of the apparatus 10 are shown schematically in FIGS. 4 and 5. A solution pump 80 is powered by the agitation device 40 and is used to pump cleaning solution to the cleaning head 12. The flow of solution is driven by a solution impeller wheel 82 which is connected to the air impeller wheel 50 by a drive shaft 84. The solution is stored in a tank 86 and is drawn into the pump 80 through a first line 88. The solution is pumped to a fluid dispensing valve 90 through a second line 92. Upon shifting of the valve 90 to an open condition, the solution is dispensed down a third line 94 to the cleaning head 12. The third line 94 terminates at an outlet port 95 formed in the cleaning head 12 directly above the sponge 20.

Figure 6:
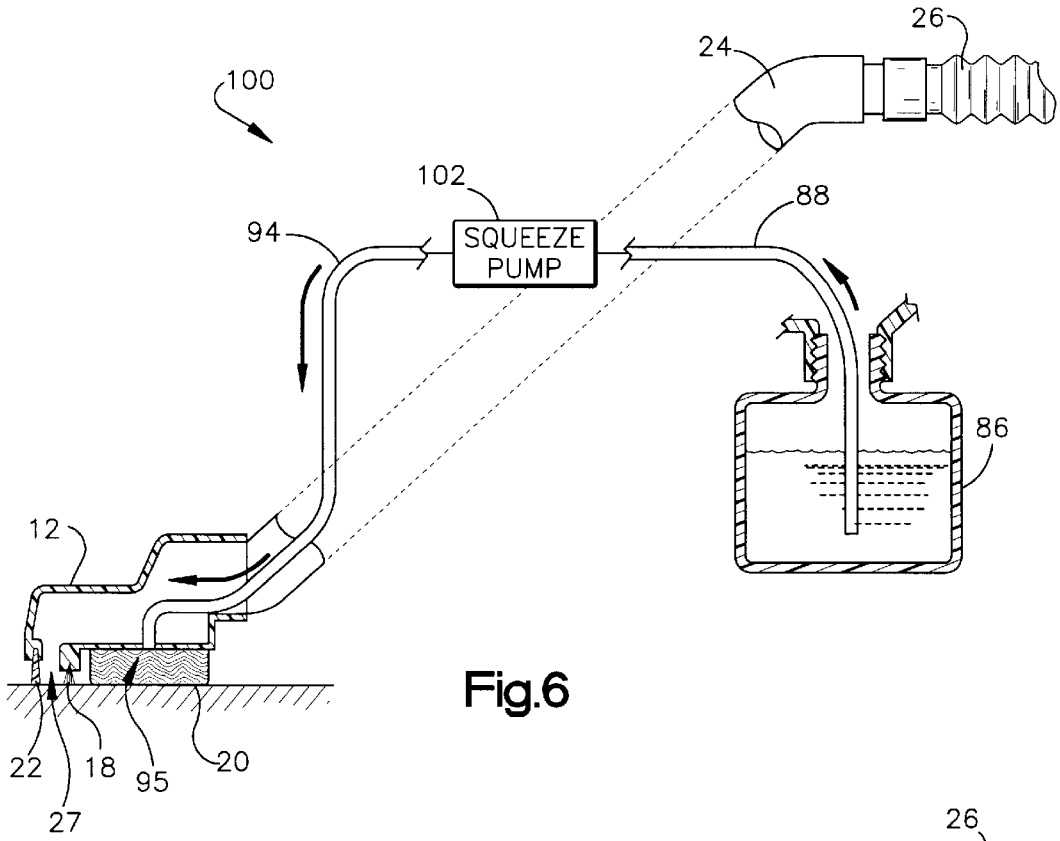
FIG. 6 is a view similar to FIG. 4 showing an apparatus comprising a second embodiment of the invention.

An apparatus 100 comprising a second embodiment of the present invention is shown partially in FIG. 6. The apparatus 100 is substantially the same as the apparatus 10, but includes a hand operated squeeze pump 102 in place of the air operated pump 80 and the valve 90 of FIG. 4.

Figure 7:
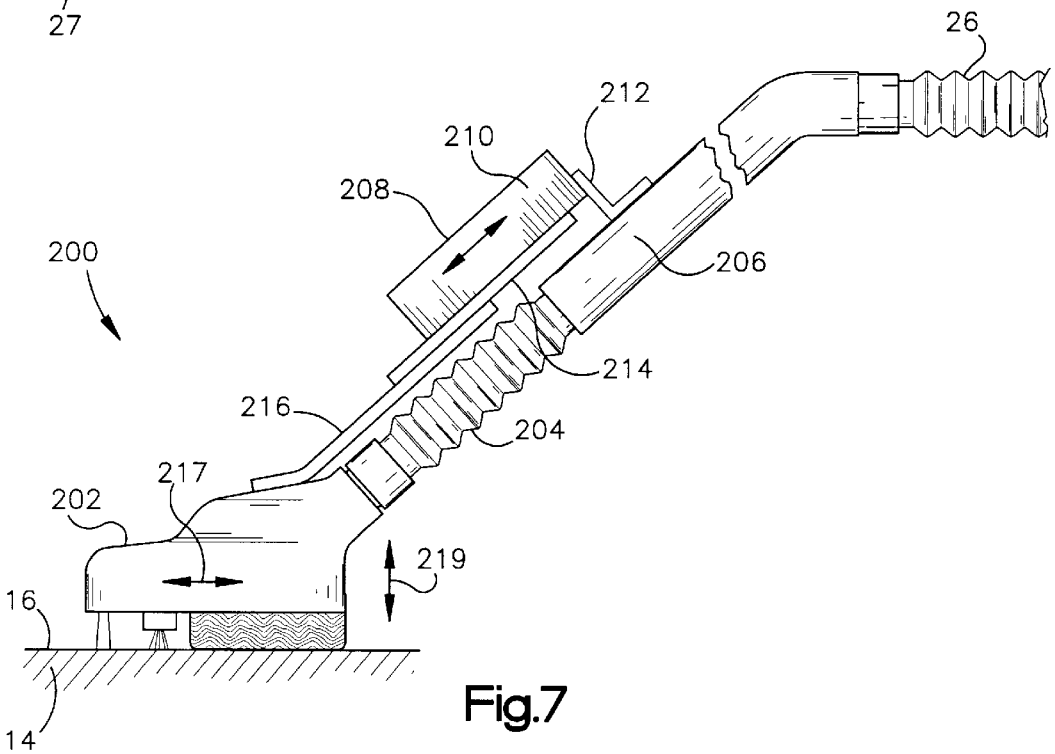
FIG. 7 is a view similar to FIG. 1 showing an apparatus comprising a third embodiment of the invention.

An apparatus 200 comprising a third embodiment of the present invention is shown partially in FIG. 7. The apparatus 200 includes a cleaning head 202 which is substantially is the same as the cleaning head 12 described above. A hose portion 204 of the apparatus 200 communicates the cleaning head 202 pneumatically with a hollow handle portion 206 which, in turn, communicates pneumatically with the vacuum cleaner suction hose 26.

The apparatus 200 further includes a pneumatically powered vibratory agitation device 208 in place of the pneumatically powered vibratory agitation device 40 described above. A housing portion 210 of the device 208 is fixed to the handle 206 by an upper bracket 212. An output portion 214 of the device 208 is fixed to the cleaning head 202 by a lower bracket 216. When the device 218 is actuated, the output member 214 reciprocates vibrationally relative to the housing 210 in the opposite directions indicated by the arrow shown in FIG. 7. Accordingly, when the device 208 is actuated, the cleaning head 202 is similarly reciprocated relative to the handle 206. This results in the application of horizontal and vertical cleaning forces to the floor surface 16 when the cleaning head 202 is in scrubbing engagement with the floor 14, as indicated by the horizontal and vertical cleaning force vectors 217 and 219 shown in FIG. 7. The agitation device 208, which is shown schematically in FIG. 7, may comprise a device known as a KIRBY(™ ) Turbo Accessory.

The present invention has been described with reference to preferred embodiments. Those skilled in the art will perceive improvements, changes and modifications as taught by the foregoing description. Such improvements, changes and modifications are intended to be within the scope of the claims.

We claim:

1. A floor cleaning apparatus comprising:

a cleaning head configured to adjoin a floor in scrubbing engagement with the floor, said cleaning head having a cleaning solution intake port;

an agitation device having an output member, said agitation device being operative to agitate said output member under the power of a pressurized flow of air through said agitation device, said output member being interconnected with said cleaning head to impart corresponding agitation to said cleaning head upon operation of said agitation device when said cleaning head is in said scrubbing engagement with the floor; and a structure defining a plenum and a valve, said structure being configured to communicate said inlet port pneumatically with a suction hose to remove cleaning solution from the floor when said valve is in a first condition, and alternatively to communicate said vibratory agitation device pneumatically with the suction hose to power said vibratory agitation device when said valve is in a second condition shifted from said first condition.

2. A floor cleaning apparatus as defined in claim 1 wherein said corresponding agitation imparted to said cleaning head comprises oscillation of said cleaning head.

3. A floor cleaning apparatus as defined in claim 2 wherein said output member and said cleaning head are oriented relative to each other such that said oscillation imparted to said cleaning head includes reciprocation in opposite directions parallel to the floor, and further includes reciprocation in opposite directions perpendicular to the floor.

4. A floor cleaning apparatus as defined in claim 2 wherein said output member and said cleaning head are oriented relative to each other such that movement imparted to said cleaning head by said output member consists of reciprocation of said cleaning head without rotation of said cleaning head.

5. A floor cleaning apparatus comprising:

a cleaning element configured to adjoin a floor in scrubbing engagement with the floor;

a vibratory agitation device having an output member, said vibratory agitation device being operative to impart oscillation to said output member;

said output member being connected with said cleaning element so as to impart corresponding oscillation to said cleaning element upon operation of said vibratory agitation device when said cleaning element is in said scrubbing engagement with the floor; and a cleaning head supporting said cleaning element for said scrubbing engagement with the floor;

wherein said cleaning head has a cleaning solution intake port and is configured to communicate said intake port with a source of pneumatic fluid pressure for removing cleaning solution from the floor and through said intake port.

6. A floor cleaning apparatus comprising:

a cleaning element configured to adjoin a horizontal surface portion of the floor in scrubbing engagement with the floor in an ordinary operating orientation relative to the floor; and a vibratory agitation device having an output member, said vibratory agitation device being operative to impart oscillation to said output member;

said output member being connected with said cleaning element so as to impart corresponding oscillation to said cleaning element upon operation of said vibratory agitation device when said cleaning element is in scrubbing engagement with the horizontal surface portion of the floor, with said corresponding oscillation imparted to said cleaning element including reciprocation in opposite horizontal directions parallel to the horizontal surface portion of the floor and in opposite vertical directions perpendicular to the horizontal surface portion of the floor when said cleaning element is in said ordinary operating orientation; and a handle having an ordinary operating position spaced from said cleaning element in a rearward direction extending horizontally away from said cleaning element and spaced from said cleaning element in an upper direction extending vertically away from said cleaning element, said handle being connected with said cleaning element to support said cleaning element in said ordinary operating orientation when said handle is in said ordinary operating position.

* * * * *

UNITED STATES PATENT AND TRADEMARK OFFICE

CERTIFICATE OF CORRECTION

PATENT NO. : 6,353,964 B1 
DATED : March 12, 2002
INVENTOR(S) : John J. Andrisin, Jr. and Wei Du It is certified that error appears in the above-identified patent and that said Letters Patent is hereby corrected as shown below:

Column 1,
Line 48, after "with the floor" delete ";" and replace with -- . --

Column 2,
Line 49, at the beginning of the line, delete "fill" and replace with -- full --

Signed and Sealed this

Eleventh Day of June, 2002

*Attest:*

*Attesting Officer*

JAMES E. ROGAN
*Director of the United States Patent and Trademark Office*